United States Patent [19]

Cedergreen

[11] Patent Number: 4,846,089

[45] Date of Patent: Jul. 11, 1989

[54] HATCH WITH RELEASABLE HINGE ASSEMBLY

[75] Inventor: Steven D. Cedergreen, Seattle, Wash.

[73] Assignee: Tempress Incorporated, Seattle, Wash.

[21] Appl. No.: 90,028

[22] Filed: Aug. 27, 1987

[51] Int. Cl.[4] ..... B63B 19/14

[52] U.S. Cl. ..... 114/201 R; 114/178; 16/126; 16/257; 16/267; 49/460

[58] Field of Search ..... 114/201 R, 178, 203, 114/117; 49/460, 400, 490, 499, 498; 16/124, 125, 126, 127, 257, 267

[56] References Cited

U.S. PATENT DOCUMENTS

| | | | |
|---|---|---|---|
| 311,953 | 2/1885 | Burgess | 16/126 |
| 630,886 | 8/1899 | Held | 16/126 |
| 896,282 | 8/1908 | Durkee | 114/201 R |
| 2,051,757 | 8/1936 | Travis | 49/490 |
| 3,130,651 | 4/1964 | Werner | 16/267 |
| 3,209,663 | 10/1965 | Baier | 49/400 |
| 3,773,338 | 11/1973 | Fidler et al. | 49/490 |

FOREIGN PATENT DOCUMENTS

| | | | |
|---|---|---|---|
| 243679 | 11/1965 | Austria | 16/257 |
| 523560 | 7/1940 | United Kingdom | 114/201 R |

*Primary Examiner*—Joseph F. Peters, Jr.
*Assistant Examiner*—Thomas J. Brahan
*Attorney, Agent, or Firm*—Christensen, O'Connor, Johnson & Kindness

[57] ABSTRACT

A hatch for a boat or other vehicle having a cover (10) that is pivotally connected to a frame (12) by a pair of releasable hing assemblies (32) that allow separation of the cover from the frame when the cover is forcibly opened against an object on an adjacent surface (14). A pair of pivotal handles (60) are restrained against movement into a downward angular position that would interfere with the proper closure of the cover.

6 Claims, 2 Drawing Sheets

Fig. 1.
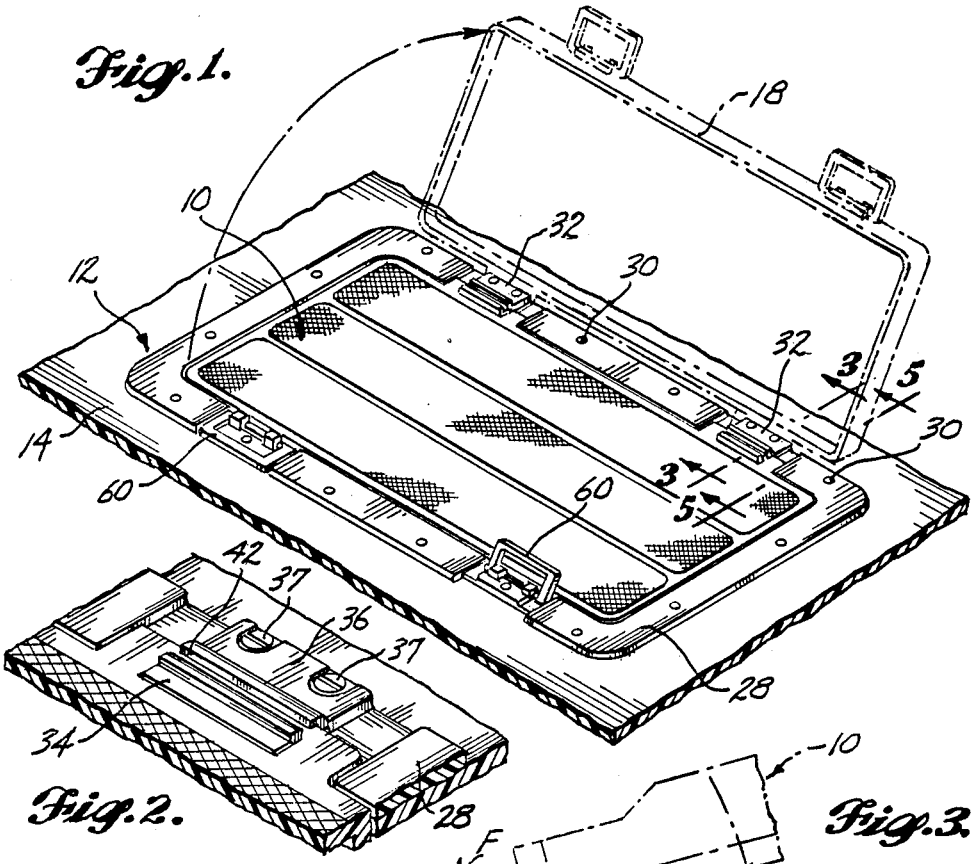
Fig. 2.
Fig. 3.
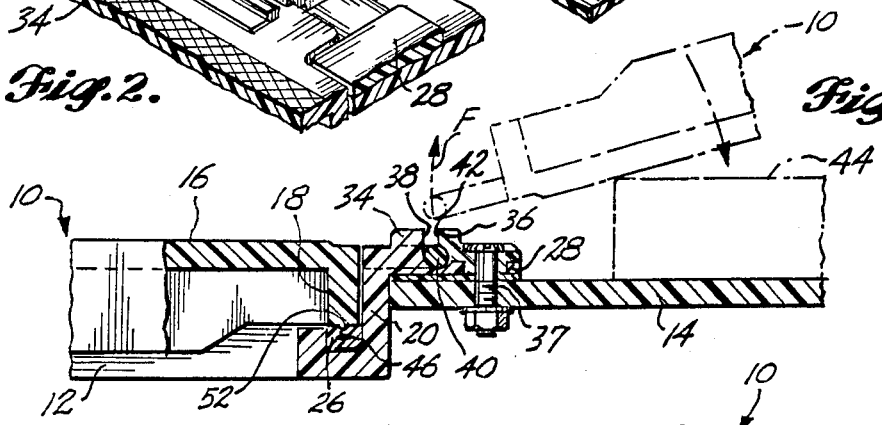
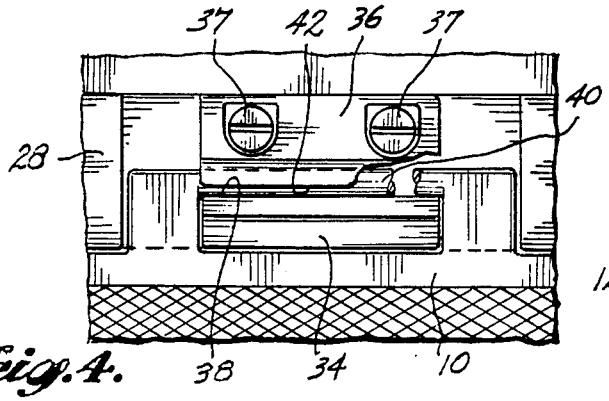
Fig. 4.
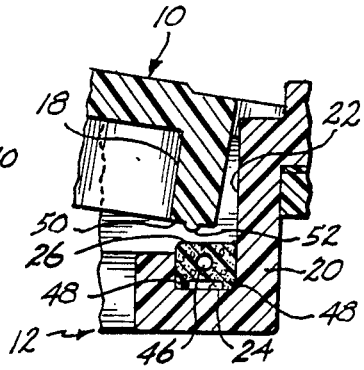
Fig. 5.

Fig. 6.
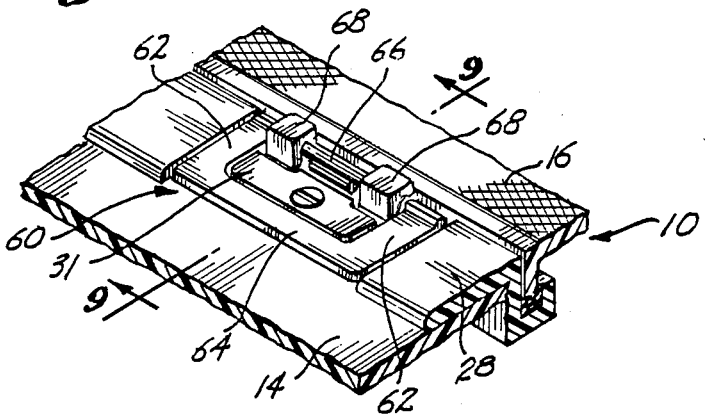
Fig. 9.
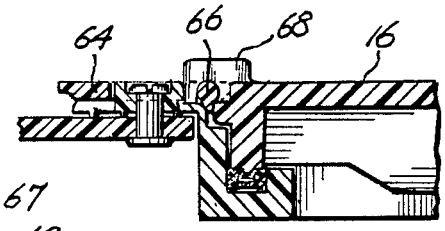
Fig. 7.
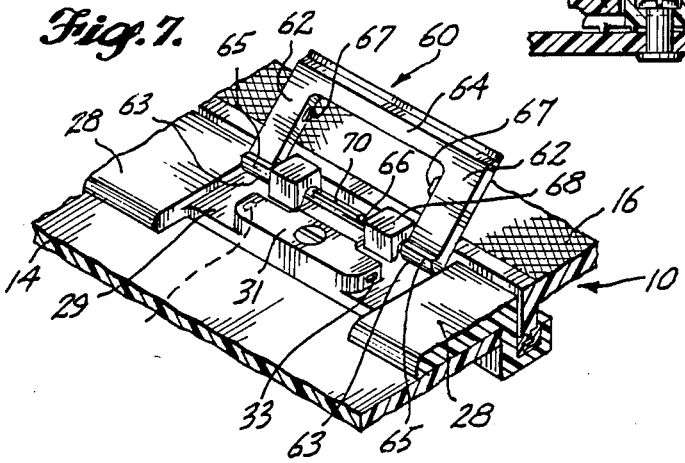
Fig. 8.
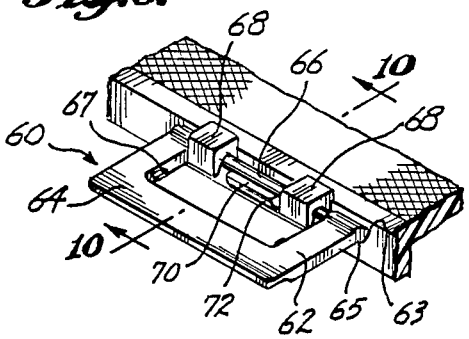
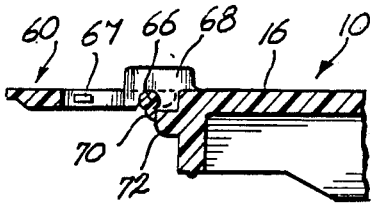
Fig. 10.

HATCH WITH RELEASABLE HINGE ASSEMBLY

BACKGROUND OF THE INVENTION

The present invention relates, in general, to a hatch of the type having a cover pivotally connected to a frame that is installed on an interior or exterior surface of a vehicle such as the deck of a boat. More particularly, the invention concerns a hatch of this type in which the cover is attached to the frame by a releasable hinge assembly that permits selective separation of the cover from the frame when the cover is inadvertently and forcibly opened against an obstruction.

SUMMARY OF THE INVENTION

In accordance with the invention, there is provided a hatch having a cover and a frame that is mountable upon an exterior or interior surface of a vehicle. The frame includes a hatch opening that extends therethrough and that is configured for complementary mating engagement with the cover. The frame also includes a hinge receptacle having a substantially planar upright wall and an arcuate flange that are positioned in opposed, facing relationship to define an elongated channel. The cover includes a hinge pin that is received by the elongated channel of the hinge receptacle to define a rotational axis about which the cover may be pivoted relative to the frame.

In accordance with an important aspect of the invention, the hinge receptacle is configured and constructed so that the hinge pin may "pop" free thereof, or release therefrom, when too great a force is applied to the hinge cover. This can occur, for example, when the cover is forced against an object such as a buoy or piece of fishing gear that is positioned on the boat deck closely adjacent the hinge receptacle. To permit separation of the hinge pin from the hinge receptacle in this instances, an opening in provided into the elongated channel and the receptacle is constructed of a flexible material so that the edges of the opening are displaceable from one another a distance that is sufficient to permit passage of the hinge pin therebetween.

In accordance with a further aspect of the invention, the hatch includes a handle that is pivotally mounted to the cover and means for restraining the angular movement of the handle to prevent the handle from rotating into a generally downward position that would interfere with the proper closure of the cover. In preferred form, the restraining means comprises a complementary pair of tabs, one of the tabs being located on the handle and the other one being located on the cover, which prevent the handle from moving beyond approximately a right angle with the side of the cover.

In marine environment, it is desirable and necessary to provide tight sealing engagement between the cover and the frame of a hatch. When opening a hatch from the outside, it is often difficult to break this tight seal. To assist in making the task of breaking such a seal easier, the handle of the present invention preferably includes a cam member that, upon rotation of the handle, is brought selectively into engagement with the frame to exert a force on the cover in a generally upward direction.

According to still other aspects of the invention, the hatch includes a specially configured seal and a raised bead on the latch cover that cooperate to insure a watertight seal between the cover and frame.

BRIEF DESCRIPTION OF THE DRAWINGS

The invention can be understood by the following portion of the specification taken in conjunction with the accompanying drawings in which:

FIG. 1 is an isometric view of a hatch according to the invention shown in its installed position on a boat deck;

FIG. 2 is an enlarged isometric view of the hatch of FIG. 1, showing the hinge assembly in greater detail;

FIG. 3 is a sectional view taken along line 3—3 of FIG. 1 and showing, in phantom line, the cover separated from the frame after striking an object on the deck;

FIG. 4 is a top view of the hinge portion of the hatch with parts broken to show the relationship between the hinge pin and the channel of the hinge receptacle;

FIG. 5 is an enlarged, partial sectional view taken along line 5—5 of FIG. 1 illustrating the seal in greater detail;

FIG. 6 is an enlarged isometric view of the hatch of FIG. 1 with parts broken showing details of the handle assembly in the cover closed position;

FIG. 7 is a view similar to that of FIG. 6, but showing the handle rotated upwardly with the cam elements in operative engagement the frame;

FIG. 8 is an enlarged isometric view of a portion of the cover showing the handle in its restrained position;

FIG. 9 is a sectional view taken along line 9—9 of FIG. 6; and

FIG. 10 is a section view taken along line 10—10 of FIG. 8.

DETAILED DESCRIPTION OF THE PREFERRED EMBODIMENT

The invention is described herein with reference to a preferred configuration as a hatch for a boat. It is to be understood, however, that the inventive hatch is not limited to boat applications.

Referring to FIG. 1, a boat hatch according to the present invention includes a cover 10 and a frame 12 that is mountable upon a deck 14 of a boat. The cover has a generally planar upper surface 16 and a generally rectangular shape when viewed from above. A downwardly depending rim 18 extends completely around the periphery of the cover to define four side edges. As seen in FIG. 3, the rim 18 is aligned on a plane that is substantially at right angles with a plane drawn through the upper surface 16.

As will be apparent to those familiar with hatch design, the frame 12 has a hatch opening therethrough that is sized and shaped to mate closely with the cover 10. Referring to FIGS. 3 and 5, the hatch opening is defined by an inner surface 22 of a wall 20 that extends around each of the four sides of the frame. The wall 20 has a J-shape so as to define a U-shaped seal channel 24 at its lower ends. The seal channel extends completely around the periphery of the frame 12 and receives a specially configured seal 26 that will be described in greater detail hereinafter.

The frame 12 further includes a lateral flange 28 that extends outward from the upper end of the wall 20 so as to rest upon the upper surface of the boat deck 14. Apertures 30 are provided at selected positions on the flange 28 to receive bolts, screws or other appropriate fasteners (not shown).

To pivotally connect the cover 10 to the frame 12, a pair of hinge assemblies 3 are provided along one side of the lateral flange 28. Referring to FIGS. 2, 3 and 4, the principal components of each of the hinge assemblies are an upstanding step 34 and an arcuate flange 36. The step 34 is positioned on the hatch opening side of the frame and has a substantially planar upright wall 38 on its outer side. The portion of the lateral flange 28 lies adjacent the lower end of the upright wall 38 as an arcuate depression that is configured to receive, in complementary manner, a hinge pin 40 that is connected to the cover 10. From this it will be appreciated that the outer face of the upright wall 38 and the depression in the lateral flange 28 form a reverse "J" when viewed from the perspective of FIG. 3.

As seen best in FIGS. 2 and 4, the outer portion of the arcuate flange 36 is relatively flat so as to lie atop the lateral flange 28. This outer portion includes a pair of mounting holes through which bolts 37 are passed to connect the flanges 28 and 36 to one another and to the deck 14. The inner portion of the arcuate flange 36 curves in an inward, upward direction and terminates at an innermost edge 42 that is spaced from the upper portion of the upright wall 38. Referring to FIG. 3, the portion of the arcuate flange below the innermost edge 42 is rounded so as to confirm to the cylindrical shape of the hinge pin 40. As will be appreciated from this figure, this inwardly facing rounded portion of the arcuate flange 36 cooperates with the upright wall 38 and the rounded depression in the lateral flange 28 to define an elongated channel that receives the hinge pin 40. The dimensions of these components are selected so that the hinge pin is free to rotate in the defined channel and thereby permit rotational movement of the cover relative to the frame. This rotational movement is sometimes characterized herein as a normal mode of operation.

The hatch is designed so that the cover 10 may be fully opened into an essentially horizontal position with the upper surface thereof lying on the deck of the boat. On occasion, the boat operators inadvertently place or leave objects on the deck in close proximity to the hatch. Such an object is illustrated by the block identified with the reference numeral 44 in FIG. 3. The hinge assemblies just described are advantageously arranged so that, when the cover 10 is forced against the object 44, the hinge pin 40 pops free of its captive position between the upright wall 38 and the arcuate flange 36 without breaking these components. For this purpose, the arcuate flange 36 is made of a material having sufficient flexibility to permit the innermost edge 42 of the arcuate flange to be displaced a distance that is sufficient to permit passage of the hinge pin 40 between that edge and the upright wall 38. Plastic materials are particularly suited for the construction of these components and is preferred, in general, for the construction of the entire hatch.

It is important to note that the releasable operation of the hinge is made possible by the placement of the upright wall 38 on the inside of the lateral flange 28 (i.e., on the side nearest the hatch opening) and the corresponding positioning of the arcuate flange 36 so that the rounded portion thereof below the innermost edge 42 faces inwardly toward the hatch opening. With this arrangement, the forces that act upon the cover 10 during the normal opening and closing generally work to keep the hinge pin 40 seated in the defined channel and against the arcuate flange 36. When, however, the cover is attempted to be forced open against an object 44, upward forces (indicated by the arrow labelled F in FIG. 3) act upon the hinge pin 40. Because of its relative flatness, the upright wall of 38 offers little resistance to the movement of hinge pin 40. Since the arcuate flange 36 has flexibility and since it is attached in a cantilever manner by the bolt 37, it is able to flex to enable sufficient separation of its edge 42 and the upright wall 34 to allow the release of the hinge pin 40.

As mentioned above, the frame 12 includes a generally U-shaped seal channel 24 that receives a specially configured seal 26 that is constructed from an elastomeric material, such as neoprene or EPDM. Referring to FIG. 5, the seal 26 has a generally rectangular cross-sectional shape and is provided with a centrally located open bore 46 throughout its entire length. The lower, or contact, surface of the seal 26 includes a pair of ridges 48 that are spaced apart from each other on opposite sides of that surface. The two ridges 48 extend in parallel relation to one another completely around the periphery of the seal. As can be seen in FIG. 5, when the seal is in its non-compressed state, the two ridges 48 provide the only points of contact between the lower surface of the seal 26 and the bottom, or cross surface of the U-shaped channel 24.

Upon closure of the cover 10, a lower surface 50 of the rim 18 bears against and thereby compresses the seal 26. When this occurs, the two parallel ridges 48 are forced into tight sealing engagement with the two corners of the seal channel 24 to effect a watertight seal between the cover 10 and frame 12. To further enhance the sealing action, the lower surface 50 of the rim includes a raised bead 52. The bead 52 extends completely around the lower surface 50 and is centrally located thereon. As seen in the cross-sectional view of FIG. 5, the bead has a semi-cylindrical configuration. When the cover 10 is in its closed position (see FIG. 3) the bead 52 is aligned in a plane that extends substantially through the axis of bore 46 and that is positioned approximately in equal distance from each of the two ridges 48. As a result of the arrangement, the bead 52 bears down upon the seal 26 in a manner that forces the ridges 48 into the corners of the seal channel to enhance the effectiveness of the seal.

The cover 10 also includes a pair of handles 60 that are pivotally mounted thereto on the side opposite the hinge assemblies 32. Each handle has a C-shaped outer portion consisting of two arms 62 that are joined by a crosspiece 64. A hinge pin 66 is connected between the inner ends of the arm 62. The hinge pin 66 is generally cylindrically-shaped and is positioned a distance outward (i.e., towards the crosspiece 64) from the innermost ends 63 of the two arms 62 for reasons that will be explained hereinafter.

The hinge pin 66 is pivotally mounted in a pair of blocks 68 that extend outward from the handle edge of the cover 10. More specifically, the blocks 68 have aligned channels that are opened on the underside of the blocks and that are sized and configured relative to the hinge pin 66 so that the hinge pin (and hence the handle 60) may be rotated therein.

Means for restricting the extent of rotational movement of the handles are included for convenience of use and to prevent the handle from rotating into a downward position where they would be susceptible to a breakage or would interfere with proper closure of the cover. In the illustrated embodiment, these restraint means comprise a handle tab 70 located on the hinge pin 66 and a cover tab 72 located on the handle side of the cover 10 below and between the two blocks 68. As seen best in FIGS. 8 and 10, the handle tab 70 and the cover tab 72 have abutting faces that engage one another when the handle 60 is rotated into a position where it extends outward, substantially at a right angle to the handle edge of the cover 10, so as to be oriented in a plane that is substantially parallel to the upper surface of the cover 10. The two tabs 70 and 72 will thus prevent rotation of the handle further downward beyond the position illustrated in FIGS. 8 and 10. However, these tabs are disengaged as soon as the handle is rotated upwardly, thereby permitting the handle to be rotated fully into the angular position illustrated in FIG. 7 where the upper surfaces of the two arms 62 engage the corner where the upper surface 26 of the cover meets the hinge side edge.

As noted above, the hinge pin 66 is positioned outwardly from the innermost ends 63 of the arms. From this positioning, it will be appreciated that the innermost ends 63 of the arms move through a rotational path that is spaced inward from the axis of rotation of the handle. This arrangement is provided so that the handle performs an additional function of assisting in breaking the seal that exists when the cover 10 is tightly closed upon the frame 12. For this purpose, the lower surface of each of the arms 62 has a cam member 65 having a contact surface that curves downwardly and rearwardly when viewed from a side perspective such as that shown in FIG. 10. This surface of each of the cam members 65 engages a flat surface 29 (see FIG. 7) of a handle-receiving recess formed in the lateral flange 28 of the frame 12. It will be understood that, as the handle is rotated from the closed position shown in FIG. 6 to the fully opened position in FIG. 7, the movement of the curved surface and, eventually the innermost edges 63, against the flat surface 29 produces upward lifting forces that act through the hinge pin 66 and the block 68 to lift the cover 10 relative to he frame and thereby assist in breaking the seal that exists between the lower surface 50 of the rim 18 and the elastomeric seal 26. It is to be appreciated that this camming action is particularly useful in breaking a tight seal that occurs when there is moisture within the seal area.

Referring again to FIG. 6, it will be seen that the recess in the lateral flange 28 that receives the handle 60 includes an island 31 that is surrounded by the arm 62 and crosspiece 64 when the handle is closed. Referring to FIG. 7, the two opposed side edges of the island each include a recess 33. These recesses are configured to receive respective ones of a pair of snap tabs 67 disposed on the inner edges of the arms 62. The snap tabs 67 thus engage the recesses 33 to hold the handle in a releasable, snapped closed condition.

From the foregoing, it will be appreciated that the invention provides a hatch having releasable hinge assemblies and selectively restrainable hinges that lessen the likelihood of breakage of these components. In addition, the invention provides a uniquely configured elastomeric seal that operates in conjunction with an especially configured surface on the rim of the cover to ensure a water tight seal between the cover and frame.

While the invention has been described with reference to a preferred embodiment, it will be understood to those skilled in the art that the invention is not limited thereto and that the scope of the invention is to be interpreted only in conjunction with the following claims.

The embodiments of the invention in which an exclusive property or privilege is claimed are defined as follows:

1. a hatch, comprising:

a cover, said cover having a hinge side and a handle side, said cover including a hinge pin having a predetermined cross-sectional dimension;

a frame mountable upon a surface, said frame having:

a hatch opening extending therethrough, said opening being shaped and configured for complementary mating engagement with said cover, said opening having a hinge side that corresponds to the hinge side of said cover;

a hinge receptable positioned adjacent the hinge side of said hatch opening, said receptacle having a substantially planar upright wall and an arcuate flange that are positioned in opposed facing relationship to define an elongated channel, the hinge pin of said cover being positioned in said channel for rotational movement therein, said upright wall being disposed on the side of said hatch adjacent said hatch opening, said arcuate flange curving in an unward direction towards said hatch opening and terminating at an innermost edge that is spaced from said upright wall, said innermost edge and upright wall defining an opening into said channel, said opening facing upwards and away from a surface upon which said frame is installed, said opening being dimensioned smaller than the cross-sectional dimension of said hinge pin such that said hinge pin is contained within said channel and permitted to rotate during normal operation, said receptacle being constructed of a flexible material such that the innermost edge of said arcuate flange is displaceable from said upright wall a distance that is sufficient to permit passage of said hinge pin herebetween, said arcuate flange being automatically displaceable by a force caused by movement of said hinge pin.

2. The hatch of claim 1, further including:

a handle pivotally mounted to the handle side of said cover for rotational movement relative thereto; and restraining means for restraining said handle from moving beyond a predetermined angular position relative to the handle side of said cover.

3. The hatch of claim 2, wherein the handle side of said cover has a generally planar surface, and wherein said predetermined angular position lies substantially at a right angle with respect to said handle side.

4. A hatch of claim 2, wherein said handle includes a cam member, said cam member being brought selectively into engagement with said frame upon rotation of said handle when said cover is engaged with said hatch opening, said cam member cooperating with said frame to exert a force on said cover in a generally upward direction.

5. The hatch of claim 2, wherein said restraint means comprises a complementary pair of tabs, one of said tabs being located on said handle and the other one of said tabs being located on said cover, the tab on said handle being movable into and out of engagement with the tab on said cover by rotation of said handle.

6. The hatch of claim 2, wherein said frame includes a seal channel located adjacent the inner periphery of said hatch opening, said channel having a generally U-shaped cross-section with a bottom surface extending between two upright side surfaces, said hatch further including:

a seal, said seal being constructed of an elastomeric material and having a generally rectangular cross-sectional shape, said seal including a pair of parallel ridges positioned opposite one another on one of the sides thereof, said ridges extending around the periphery of said seal, said seal being positioned in said seal channel so that the side having said ridges engages said bottom surface;

and wherein said cover includes a downwardly depending rim that is configured for complementary mating engagement with said seal channel, said rim including a contact surface that engages said seal, said contact surface including a raised bead that is positioned to engage the side of said seal opposite said ridges.

* * * * *

UNITED STATES PATENT AND TRADEMARK OFFICE

CERTIFICATE OF CORRECTION

PATENT NO. : 4,846,089

DATED : July 11, 1989

INVENTOR(S) : Steven D. Cedergreen

It is certified that error appears in the above-identified patent and that said Letters Patent is hereby corrected as shown below:

On the title page, after "FOREIGN PATENT DOCUMENTS," add the following:

OTHER PUBLICATIONS

Product Specification Sheet dated 1979 with Photograph of Foam Hatch Cover

Detail Drawing of "Living" Hinges and "Living" Handles for Hatch Cover

Drawing of Pivotal, Snap-In Handle for Hatch Cover

Drawing of Pivotal Hinge for Hatch Cover

UNITED STATES PATENT AND TRADEMARK OFFICE

CERTIFICATE OF CORRECTION

PATENT NO. : 4,846,089

DATED : July 11, 1989

INVENTOR(S) : Steven D. Cedergreen

It is certified that error appears in the above-identified patent and that said Letters Patent is hereby corrected as shown below:

Column 1, line 55, after "In" insert --a--;

Column 1, line 67, "latch" should be "hatch";

Column 2, line 26, after "engagement" insert --with--;

Column 2, line 57, "ends" should be "end";

Column 3, line 24, "confirm" should be "conform";

Column 4, line 39, "the arrangement" should be "this arrangement";

Column 5, line 37, "he frame" should be "the frame";

Column 5, line 60, "water tight" should be "watertight";

Column 6, line 36, "herebetween" should be "therebetween".

Signed and Sealed this

Twelfth Day of June, 1990

*Attest:*

HARRY F. MANBECK, JR.

*Attesting Officer*

*Commissioner of Patents and Trademarks*